US011326344B2

(12) United States Patent
Yu et al.

(10) Patent No.: US 11,326,344 B2
(45) **Date of Patent: *May 10, 2022**

(54) IN-FRAME SHEAR WALL

(71) Applicant: VERCO DECKING, INC., Phoenix, AZ (US)

(72) Inventors: Cheng Yu, Southlake, TX (US); Jeffrey Reino Martin, Fremont, CA (US); Richard B. Haws, Corinth, TX (US)

(73) Assignee: VERCO DECKING, INC., Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/084,189

(22) Filed: Oct. 29, 2020

(65) Prior Publication Data

US 2021/0115665 A1 Apr. 22, 2021

Related U.S. Application Data

(63) Continuation of application No. 15/466,983, filed on Mar. 23, 2017, now Pat. No. 10,822,793.
(Continued)

(51) Int. Cl.
*E04B 2/56* (2006.01)
*E04C 2/32* (2006.01)
(Continued)

(52) U.S. Cl.
CPC ..... *E04B 2/56* (2013.01); *E04B 1/08* (2013.01); *E04C 2/322* (2013.01); *E04C 2/384* (2013.01); *E04D 3/30* (2013.01)

(58) Field of Classification Search
CPC ... E04B 2/56; E04B 2/562; E04B 2/58; E04B 2/7854; E04B 1/08; E04C 2/08;
(Continued)

(56) References Cited

U.S. PATENT DOCUMENTS 2,101,090 A 12/1937 Vincent
2,256,394 A 9/1941 Lamel
(Continued)

FOREIGN PATENT DOCUMENTS

DE 4446227 1/2006

OTHER PUBLICATIONS

"Canam MD2000" (Canam Construction); last archived Mar. 19, 2016; retrieved from ittps://web.archive.orgweb/20160319233641/https://www.canam-construction.com/wp-content/uploads/2014/12/md2000-icf-eng-1.pdf; retrieved May 30, 2017; all pages.
(Continued)

*Primary Examiner* — Brian E Glessner
*Assistant Examiner* — James J Buckle, Jr.
(74) *Attorney, Agent, or Firm* — Moore & Van Allen PLLC; Jeffrey R. Gray

(57) ABSTRACT

Embodiments of the invention relate to structural panel systems, and in particular in-frame fluted panel systems. The in-frame fluted panel systems allow for improved strength and/or ductility within a reduced wall thickness by installing the fluted panels within the framing of the support members in various configurations. The in-frame fluted panel systems further allows for easier construction and lower costs than conventional systems that have fluted panels located outside of the support members.

20 Claims, 13 Drawing Sheets

Related U.S. Application Data

(60) Provisional application No. 62/312,872, filed on Mar. 24, 2016.

(51) Int. Cl.
*E04D 3/30* (2006.01)
*E04B 1/08* (2006.01)
*E04C 2/38* (2006.01)

(58) Field of Classification Search
CPC . E04C 2/384; E04C 2/32; E04C 2/322; E04C 2/3405; E04D 3/30; E04F 10/08
USPC ..... 52/772; 245/124, 126
See application file for complete search history.

(56) References Cited

U.S. PATENT DOCUMENTS

| | | | |
|---|---|---|---|
| 2,383,370 | A | 8/1945 | Dean |
| 3,037,593 | A | 6/1962 | Webster |
| 3,295,283 | A | 1/1967 | Griffith et al. |
| 3,308,596 | A | 3/1967 | Cooper et al. |
| 3,568,388 | A | 3/1971 | Flachbarth et al. |
| 3,631,647 | A | 1/1972 | Merkin |
| 3,633,327 | A | 1/1972 | Klingensmith et al. |
| 4,037,379 | A | 7/1977 | Ozanne |
| 4,099,359 | A | 7/1978 | Sivachenko |
| 4,182,080 | A | 1/1980 | Naylor |
| 4,186,535 | A | 2/1980 | Morton |
| 4,186,541 | A | 2/1980 | Sivachenko |
| 4,291,510 | A | 9/1981 | Sivachenko |
| 4,333,280 | A | 6/1982 | Morton |
| 4,335,557 | A | 6/1982 | Morton |
| 4,685,261 | A | 8/1987 | Seaquist |
| 5,390,466 | A | 2/1995 | Johnson et al. |
| 5,494,261 | A | 2/1996 | Gandara |
| 5,544,464 | A | 8/1996 | Dutil |
| 5,619,837 | A | 4/1997 | Disanto |
| 5,628,495 | A | 5/1997 | Gandara |
| 5,855,099 | A | 1/1999 | Hoffman |
| 6,079,168 | A | 6/2000 | Shaver |
| 6,205,725 | B1 | 3/2001 | Butler |
| 6,250,029 | B1 | 6/2001 | Jeffers et al. |
| 6,260,323 | B1 | 7/2001 | Hockey |
| 6,385,942 | B1 | 5/2002 | Grossman et al. |
| 6,460,305 | B1 | 10/2002 | Vanhaitsma et al. |
| 6,484,460 | B2 | 11/2002 | Vanhaitsma |
| 6,668,508 | B2 | 12/2003 | Boone et al. |
| 7,634,878 | B1 | 12/2009 | Motosko |
| 7,900,411 | B2 | 3/2011 | Antonic |
| 7,900,681 | B2 | 3/2011 | Sweeney |
| 7,975,440 | B2 | 7/2011 | Motosko et al. |
| D652,956 | S | 1/2012 | Tanaka et al. |
| 8,112,968 | B1 | 2/2012 | Mueller |
| 8,281,551 | B2 | 10/2012 | Leek et al. |
| 8,468,774 | B2 | 6/2013 | Garry |
| 8,539,730 | B2 | 9/2013 | Madsen et al. |
| 9,010,054 | B2 | 4/2015 | Herdt et al. |
| 9,340,977 | B2 | 5/2016 | Nanayakkara |
| 2005/0284073 | A1 | 12/2005 | Leek et al. |
| 2010/0275540 | A1 | 11/2010 | Leek et al. |
| 2011/0113725 | A1 | 5/2011 | Garry |
| 2012/0042597 | A1 | 2/2012 | Ray |

OTHER PUBLICATIONS

International Search Report and Written Opinion for International Application No. PCT/US17/23737 completed Jun. 1, 2017.

Serrette, R.L., Nguyen, H., Hall, G. (1996). "Shear wall values for light weight steel framing." Report No. LGSRG-3-96, Santa Clara University. Santa Clara, CA.

Serrette, R.L. (1997). "Additional Shear Wall Values for Light Weight Steel Framing." Report No. LGSRG-1-97, Santa Clara University. Santa Clara, CA.

Serrette, R.L. (2002). "Performance of Cold-Formed Steel-Framed Shear Walls: Alternative Configurations," Final Report: LGSRG-06-02, Santa Clara University. Santa Clara, CA.

Yu, C. (2010). "Shear Resistance of Cold-Formed Steel Framed Shear Walls with 0.686-mm, 0.762-mm, and 0.838-mm Steel Sheet Sheathing", Elsevier, Engineering Structures, 32 (2010) 1522-1529. Structures, 32 (2010) 1522-1529.

Yu, C., Chen, Y. (2011). "Detailing Recommendations for 1.83-m Wide Cold-Formed Steel Shear Walls with Steel Sheathing", Elsevier, Journal of Constructional Steel Research, 67 (2011) 93-101.

Yu, C., Huang, Z., and Vora, H (2009). "Cold-Formed Steel Framed Shear Wall Assemblies with Corrugated Sheet Steel Sheathing", 2009 Joint SSRC Annual Stability Conference and North American Steel Construction Conference, Phoenix, AZ.

IN-FRAME SHEAR WALL

CROSS REFERENCE AND PRIORITY CLAIM UNDER 35 U.S.C. § 120

The present application for a patent claims priority to U.S. Non-Provisional patent application Ser. No. 15/466,983 entitled "In-Frame Shear Wall" filed on Mar. 23, 2017, which issued into U.S. Pat. No. 10,822,793 on Nov. 3, 2020, and which claims priority to U.S. Provisional Patent Application Ser. No. 62/312,872 entitled "In-Frame Shear Wall" filed on Mar. 24, 2016, both of which are assigned to the assignees hereof and hereby expressly incorporated by reference herein.

STATEMENT OF GOVERNMENT INTEREST

This invention was made with government support under PFI:AIR-TT Grant #1445065 entitled "Innovative High-Performance Cold-Formed Steel Walls for Light Framed Construction" awarded by the National Science Foundation. The government has certain rights in the invention.

FIELD

This application relates generally to the field of structural panel systems, in particular structural wall and roof panel systems, and more particularly to structural wall panel systems, with improved strength and/or ductility.

BACKGROUND

Structural wall or roof panels (collectively "structural panels") are used in commercial or industrial construction (and in some cases residential construction), for example, in commercial buildings, industrial buildings, institutional buildings, or the like. Structural panels, may be typically manufactured from steel sheets, which may or may not be coiled. In order to increase the structural strength and the stiffness of the individual steel sheets, structural panels with longitudinal flutes are formed from the steel sheets via roll forming, break forming, bending, stamping, or other like processes. The structural panels are secured to each other and to other load resisting structural support members in order to form a structural panel system when installed (e.g., wall system, roof system, combination thereof, or other like panel system).

In geographic regions that are prone to seismic activity (e.g., earthquakes) and/or high winds, the structural panels are solidly connected to each other and to the other load resisting structural members of the building so that the building is better able to withstand shear/lateral forces (e.g., in-plane and out-of-plane shear forces) created by the seismic activity and/or high winds. The structural panels are connected to reduce, or eliminate excessive, out-of-plane separation of the structural panels, or longitudinal movement between the edges of the structural panels (e.g., at the sidelap). To this end, the edges between adjacent structural panels are joined in such a way as to create resistance in-plane along the length of the edges (e.g., parallel with the edges) to thereby carry loads (e.g., resist forces) and prevent displacement between the structural panels along the edges. In addition, the connection of the structural panels at the edges also creates resistance out-of-plane along the edges (e.g., perpendicular to the edges) to thereby carry loads and prevent one panel lifting off an adjacent panel.

BRIEF SUMMARY

Structural panels utilized within a structural panel system of a building typically include longitudinal flutes (e.g., upper panel flange, lower panel flange, and panel webs that form a single flute as discussed in further detail later) that run longitudinally along the length of the panel in order to provide structural strength to the panels, and thus, to the structural panel system and building system. The structural panels typically comprise two edges and two ends. The edges of structural panels run parallel with the longitudinal flutes, while the ends of the structural panels run transverse (or perpendicular) to the longitudinal flutes. As such, one edge of the structural panels may be described as a "first edge" (or a "top edge" or "left edge") while the second edge of the structural panels may be described as a "second edge" (or a "bottom edge" or "right edge"). The ends of the structural panels may be described as a "first end" (or a "top end" or "left end") and a "second end" (or a "bottom end" or "right end").

The structural in-frame fluted panel system configurations described herein provides similar, the same, or improved strength and/or ductility over fluted panel systems in which the panels, and thus the flutes of the panels, are located outside of support members of the frame (e.g., outside the openings of the support members, or otherwise outside of the width of the support structures). In addition to achieving the desired strengths, the in-frame fluted panel system allows for easier construction and lower costs when compared to fluted panel systems in which the panels are coupled to support members outside of the support members. Moreover, the in-frame configurations provide smooth surfaces for easier finishing of the wall panels (e.g., no flutes extending beyond the support members). For example, the shear wall structural fluted panel systems having panels within the width of the support members (e.g., studs, rolled or bent studs, or the like) results in panel systems that have the same width as adjacent members within the building, such as but not limited to window framing, door framing, non-structural walls, or the like. By including the panels within the width of standard support member sizes, the in-frame configurations described herein allow for easily covering the structural panels (as well as the door framing, window framing, etc.) with drywall, plaster, or other building material. The covering of the in-frame structural panels and other building elements with other construction materials without having to account for fluted panels being located outside of the support members vastly improves the cost, time, and difficulty with in constructing the building. It should be understood that the structural panel systems described herein may be prefabricated before shipping to constructions sites or formed on location.

Embodiments of the invention comprise a structural panel system. The structural panel system comprises a support structure having support members having a support structure width, and one or more panels operatively coupled to the support structure. Each of the one or more panels comprise flutes, opposing ends, and opposing edges, and the flutes of the one or more panels are generally parallel with the opposing edges. The flutes of the one or more panels are oriented generally perpendicular with the support members of the support structure. Moreover, the flutes of the one or more panels are located within the width of the support structure.

In further accord with embodiments of the invention, the structural panel system further comprises end support couplings. Moreover, the support structure comprises a first support member and a second support member, wherein the first support member and the second support member each have a web and a first flange and a second flange operatively coupled to the web and an opening formed by the web, the first flange, and the second flange. The opposing ends of the one or more panels are located within the openings of the first support member and the second support member. The end support couplings operatively couple the opposing ends of the one or more panels to the first flanges within the openings of the first support member and the second support member.

In other embodiments, the structural panel system further comprises an intermediate support member and panel support couplings. The intermediate support member has a width smaller than the width of the first support member and the second support member of the support structure. The one or more panels are operatively coupled to the first intermediate flange of the intermediate support member using the panel support couplings.

In yet other embodiments of the invention, the intermediate support member comprises an intermediate web, a first intermediate flange and a second intermediate flange operatively coupled to the intermediate web, and an intermediate opening formed from the intermediate web, the first intermediate flange, and the second intermediate flange, and wherein the one or more panels are operatively coupled to the first intermediate flange of the intermediate support member outside of the intermediate opening.

In still other embodiments of the invention, the first support member and the second support member are c-shaped.

In further accord with embodiments of the invention, the first intermediate flange has a first intermediate lip and the second intermediate flange has a second intermediate lip.

In other embodiments, the invention further comprises an intermediate support member comprising a first intermediate opening and a second intermediate opening each having a first intermediate flange, second intermediate flange, and a web. Moreover, the one or more panels at least comprise a first panel comprising first flutes, first opposing ends, and first opposing edges, a second panel comprising second flutes, second opposing ends, and second opposing edges. The end support couplings operatively couple the first opposing ends of the first panel to the first flange in the opening of the first support member and to the first intermediate flange in the first opening of the intermediate support member. The end support couplings further operatively couple the second opposing ends of the second panel to the first flange in the opening of the second support member and to the first intermediate flange in the second opening of the intermediate support member.

In yet other embodiments of the invention, the intermediate support member is an I-shape or an H-shaped single intermediate member.

In still other embodiments of the invention, the intermediate support member comprises a first intermediate support member and a second intermediate support member operatively coupled together. The web of the intermediate support member is formed from a first intermediate web of the first intermediate support member and a second intermediate web of the second intermediate support member.

In yet other embodiments of the invention, the first intermediate support member and the second intermediate support members are c-shaped.

In further accord with embodiments of the invention, each of the second intermediate flanges have a lip.

In other embodiments of the invention, the first support member and the second support member are c-shaped.

In still other embodiments of the invention, the first support member and the second support member each have a lip on the second flange.

Embodiments of the invention further comprises a structural panel system. The structural panel system comprising a first support member and a second support member. The first support member and the second support member each have a web, and a first flange and a second flange operatively coupled to the web. The web, the first flange, and the second flange form openings within the first support member and the second support member. The structural panel system further comprises an intermediate support member having a first intermediate opening and a second intermediate opening each having an intermediate web operatively coupled to a first intermediate flange and a second intermediate flange. The structural panel system also comprises two or more panels, each panel having flutes, opposing ends, and opposing edges. The flutes of the panel are generally parallel with the opposing edges. End support couplings operatively coupling the two or more panels to the first support member, the intermediate support member, and the second support member. The two or more panels comprise at least a first panel and a second panel, wherein the flutes of the first panel and second panel are oriented generally perpendicular with the first support member, the intermediate support member, and the second support member. The opposing ends of the first panel are located within the opening of the first support member and the first intermediate opening of the intermediate support member, and the end support couplings operatively couple the opposing ends of the first panel to the first flange of the first support member and the first intermediate flange of the intermediate support member. The opposing ends of the second panel are located within the opening of the second support member and the second intermediate opening of the intermediate support member, and the end support couplings operatively couple the opposing ends of the second panel to the first flange of the second support member and the first intermediate flange of the intermediate support member.

In further accord with the invention, each of the second flange of the first support member and the second support member, and the second intermediate flanges of the intermediate support member have lips.

In other embodiments of the invention, the intermediate support member comprises a single intermediate member or comprises a first intermediate support member and a second intermediate support member operatively coupled together, wherein the intermediate web of the intermediate support member is formed from a first intermediate web of the first intermediate support member and a second intermediate web of the second intermediate support member.

Embodiments of the invention further comprise a structural panel system. The structural panel system comprises a first support member and a second support member. The first support member and the second support member each have a web, and a first flange and a second flange operatively coupled to the web. The web, the first flange, and the second flange form openings within the first support member and the second support member. The structural panel system further comprises an intermediate support member. The structural panel system also comprises one or more panels, each panel having flutes, opposing ends, and opposing edges. The flutes of the panel are generally parallel with the opposing edges. Couplings operatively couple the one or more panels to the first support member, the intermediate support member, and the second support member. The flutes of the one or more panels are oriented generally perpendicular with the first support member, the intermediate support member, and the second support member. The opposing ends of the one or more panels are located within the opening of the first support member and the opening of the second support member. The intermediate support member has a width smaller than widths of the first support member and the second support member.

In further accord with embodiments of the invention, the couplings are end support couplings and panel support couplings, wherein the end support couplings operatively couple the opposing ends of one or more panels to the first flanges of the first support member and the second support member, and wherein the panel support couplings operatively couple a portion of the panel to the intermediate support member where the panel crosses the intermediate support member.

In other embodiments of the invention, the intermediate support member comprises an intermediate web, and a first intermediate flange and a second intermediate flange operatively coupled to the intermediate web. The intermediate web, the first intermediate flange, and the second intermediate flange form an intermediate opening within the intermediate support member. The panel support couplings operatively couple the portion of the panel to the first intermediate flange of the intermediate support member outside of the intermediate opening.

In yet other embodiments of the invention, each of the second flange of the first support member and the second support member, and the second intermediate flange of the intermediate support member have lips.

To the accomplishment of the foregoing and the related ends, the one or more embodiments of the invention comprise the features hereinafter fully described and particularly pointed out in the claims. The following description and the annexed drawings set forth certain illustrative features of the one or more embodiments or aspects of the invention. These features are indicative, however, of but a few of the various ways in which the principles of various embodiments or aspects of the invention may be employed, and this description is intended to include all such embodiments or aspects, and their equivalents.

BRIEF DESCRIPTION OF DRAWINGS

The foregoing and other advantages and features of the invention, and the manner in which the same are accomplished, will become more readily apparent upon consideration of the following detailed description of the invention taken in conjunction with the accompanying drawings, which illustrate embodiments of the invention and which are not necessarily drawn to scale, wherein.

DETAILED DESCRIPTION

Figure 1:
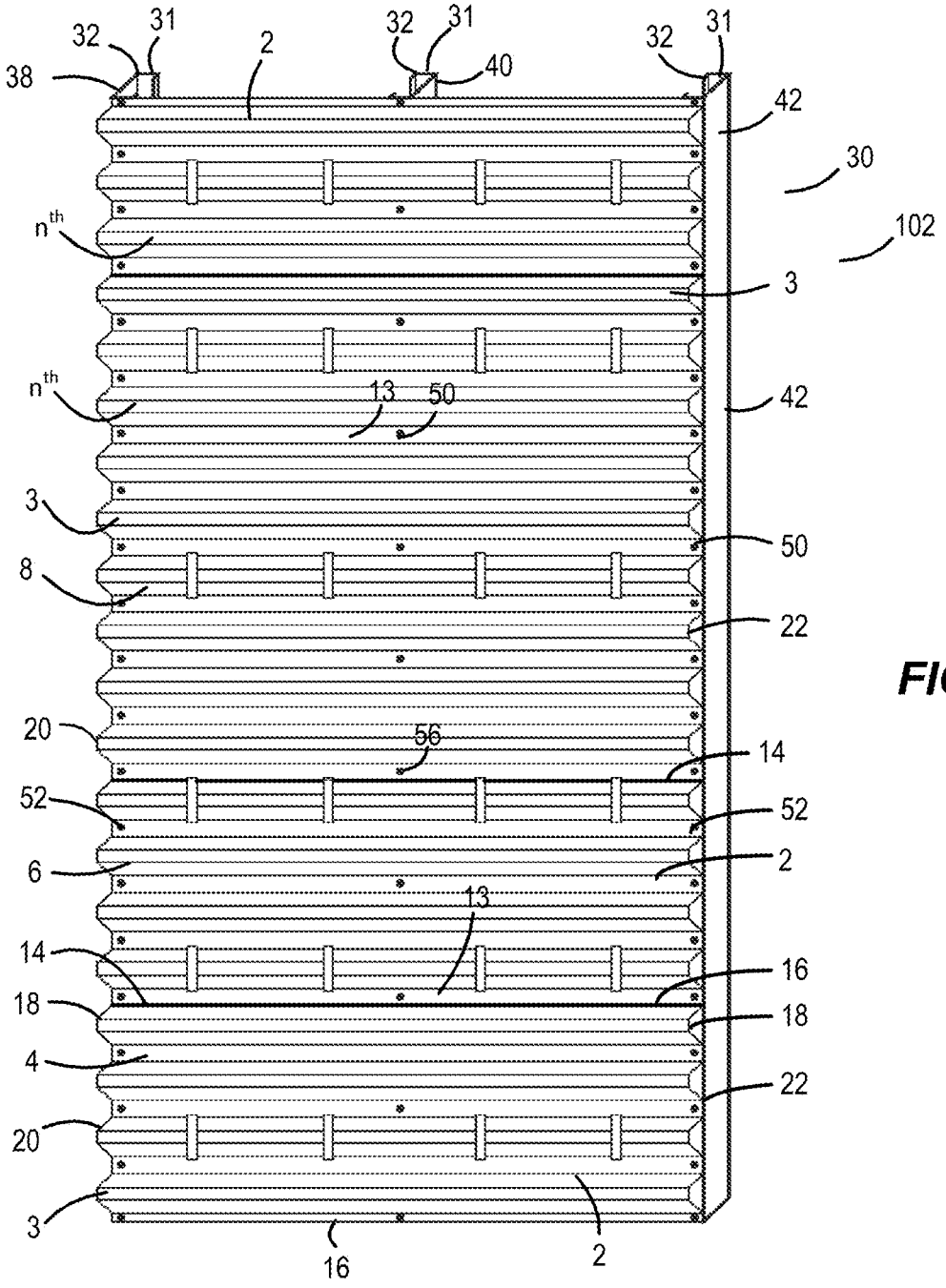
FIG. 1 illustrates a perspective view of a portion of a structural fluted panel system having fluted panels located outside of the support members of the frame.

Embodiments of the present invention now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

The structural in-frame fluted panel system configurations described herein provides similar, the same, or improved strength over fluted panel systems in which the panels, and thus the flutes of the panels, are located outside of the support members of the frame (e.g., outside the openings of the support members, or otherwise outside of the width of the support structures). In addition to achieving the desired strengths, the in-frame fluted panel system allows for easier construction and lower costs than the fluted panel systems in which the panels are coupled to support members outside of the support members. Moreover, the in-frame configurations provide smooth surfaces for easier finishing of the wall panels 2 (e.g., no flutes extending beyond the width of the support members). As such, the in-frame configurations provide continuity of the wall components in that the width of all the framing is the same for the structural shear wall fluted panels, the doors, the windows, the non-structural framing, or the like throughout the building.

As illustrated throughout the various figures, the panels 2 are operatively coupled to a support structure 30 (e.g., frame, or the like) using couplings 50 at coupling locations (otherwise described herein as a joint, attachment, or the like locations). The fluted panel system 1 includes structural panels 2 (e.g., wall panels, or the like), such as a first wall panel 4, a second wall panel 6, a third wall panel 8, and an $n^{th}$ wall panel located laterally adjacent to one another, and configured to form at least a portion of the fluted panel system 1. In other aspects of the invention, the structural panel used between two support members 30 (e.g., a first support member and a second support member) may be a single panel 2. As such, it should be understood that the panels 2 used in the fluted panel system 1 may include multiple panels 2 (more than two located longitudinally adjacent to each other) operatively coupled together, or may include a single panel 2 between the span of each support member (e.g., between first and second support members, and/or between first, second, and intermediate support members).

Each panel 2 may include edges 12, such as a first edge 14 and a second edge 16, as well as ends 18, such as a first end 20 and a second end 22. The edges 12 of structural panels run parallel (e.g., 0 degrees, or the like), substantially parallel (e.g., −10 to 10 degrees, or the like), or generally parallel (e.g., −45 degrees to 45 degrees, or the like) with the longitudinal flutes 3, while the ends of the structural panels run perpendicular (e.g., 90 degrees, or the like), substantially perpendicular (e.g., 80 to 100 degrees, or the like), or generally perpendicular (e.g., 45 degrees to 135 degrees, or the like) to the longitudinal flutes 3.

Sidelaps 13 (e.g., sidelap seams, nested sidelaps, and/or other sidelaps where the edges of panels meet), if applicable, are formed between adjacent edges 12 of the panels 2. Couplings 50 may be made in the sidelaps 13, and operatively couple, the first edge 14 and the second edge 16 of each lateral adjacent panel 2 within the fluted wall panel system 1. Additionally, the ends 18 of each panel 2 may be operatively coupled to longitudinally adjacent structural panels 2, for example, the first end 20 of a first panel 4 may be operatively coupled to a second end 22 of a longitudinally adjacent panel (not illustrated in the Figures). As described herein, laterally adjacent panels 2 are panels 2 located parallel to each other and to the longitudinally extending flutes 3 of each panel 2, while the longitudinally adjacent panels are panels 2 located in series with each other and to the longitudinally extending flutes 3 of the panels 2. When installed to a support structure with end support members and/or intermediate support members, the flutes 3 of the panels 2 may be oriented perpendicular (e.g., 90 degrees, or the like), substantially perpendicular (e.g., 80 to 100 degrees, or the like), or generally perpendicular (e.g., 45 degrees to 135 degrees, or the like) to the end support members and/or intermediate support members.

As illustrated in the various figures, the fluted panel system 1 further includes a support structure 30. The support structure 30 may include support members 31. In some embodiments the support members 31 may be studs 32 (e.g., a first stud 38 such as a first end stud, a second stud 42 such as a second end stud, and one or more an intermediate studs 40 such as a third stud and/or $n^{th}$ studs). The support structure 30 may further include a lower cap and an upper cap (not illustrated and otherwise described as a lower track and upper track). The support structure 30 may further include other support members 31, such as joists, trusses, purlins, beams, or any other type of support members 31 that may be included in a building structure. As such, in some embodiments, as illustrated in FIGS. 1-8, the ends 18 of each of the wall panels 2 (e.g., the first end 20 of a first wall panel 4 and the second end 22 of a longitudinally adjacent wall panel) may be operatively coupled to the support members 31 (e.g., the studs 32, such as the first stud 38 and the second stud 42) in the fluted panel system 1. The components of the support structure 30, and support members 31 within the support structure 30, such as the studs 32, joists, support beams, or the like may be made of any material including, but not limited to, wood beams, metal beams, plastic material, composite material, or the like. The support members 31 may be solid or have one or more openings (e.g., cavities, or the like). Moreover, the support members 31 (e.g., studs 31) may be made of any type of shape, and in particular may include shapes that are rectangular, square, circular, oval, I-shaped, H-shaped, C-shaped, Z-shaped, S-shaped, or the like. The support members 31, are described in further detail later as having webs operatively coupled to first flanges and second flanges. It should be understood that each of the webs, flanges, and/or lips may be made in the shape of straight sections of material, curved sections of material, bent sections of material (e.g., the flanges may have one or more bends), and/or the webs, flanges, and/or lips may have apertures (e.g., cutouts, holes, notches, or other features) that provide various functions such as allowing for the passage of building components (e.g., wires, plumbing, electrical), allowing for the installation of structural bridging, reducing weight of the components, providing the desired structural properties (e.g., strength, ductility, or the like). As such, while the support members 31 are generally described herein as having a c-shape or I-shape, it should be understood that the support members 31 may be any type of shape.

The structural panels 2 may have profiles that include longitudinal flutes 3. The longitudinal flutes 3, as illustrated in the various figures (e.g., as illustrated in one example in FIG. 16), may be comprised of top flanges 84 (otherwise described as peaks, upper flanges, outer flanges, or the like), bottom flanges 86 (otherwise described as troughs, lower flanges, inner flanges, or the like), and webs 88 (e.g., the portions of the panel that are sloped, perpendicular, or generally perpendicular with the flanges 84, 86) that operatively couple the top flanges 84 to the bottom flanges 86. The combination of an outer and inner flange 84, 86, and the webs 88 create a single flute 3 for the structural panels 2. As such, the panels may be described herein as having a plurality of longitudinal flutes 3. The profiles of the panels 2 formed form the longitudinal flutes 3 may be referred to as "fluted profiles," "hat profiles", "vee profiles," "flat-bottomed profiles", "triangular profiles," "trapezoidal profiles," "dovetail profiles," or other like profiles formed from the plurality of longitudinal flutes 3.

The structural panels 2, described herein, may be manufactured from a variety of rigid materials including steel, aluminum, titanium, plastic, a composite, or another type of rigid material. Typical structural panels 2 are made of steel and are sized in ranges from 12 inches to 42 inches (inclusive) wide by 1 foot to 50 feet (inclusive) long. These dimensions include some sizes of structural panels 2, but it should be understood that any size of structural panels 2 within these ranges, overlapping these ranges, or outside of these ranges might be utilized within the present invention. The material thickness of the structural panels 2 may be any thickness; however, the panel thicknesses may correspond to 29 gage panels to 16 gage panels, inclusive. Other gage material, or the associated thicknesses therefor, may be within this range, overlap this range, or be located outside of this range.

The distance from the top of the top flange 84 and the bottom of the bottom flange 86 may generally range from ½ inch to 3 inches (inclusive) in depth; however, other ranges of depths within this range, overlapping this range, or outside of this range may be used in the profiles. For example, in some embodiments the distance may range from ½ inch to 12 inches (inclusive) in depth, or the like. The panels 2 may or may not include longitudinal ribs, bends, or cutouts that affect the moment of inertia and section modulus of the panels 2 (e.g., profile dimensions, ribs, cutouts, or the like are used to target different performance characteristics, such as but not limited to strength, stiffness, moment of inertia, and section modulus). Depending on the material thickness, the length and width of the panels 2, and the height of the top flanges 84 and bottom flanges 86, the panels 2 may weigh between 30 and 420 lbs. In other embodiments, the weight of the panels may be within, overlap, or be located outside of this range.

In some embodiments, the panel 2 has a panel length 48, ends 18 that are connected to end support members 31, and a body that crosses at least one or more intermediate support members 31. For example, the panel 2 may be operatively coupled to end support members 31 (e.g., first stud 38 and second stud 42), and cross one or more intermediate support members 31 (e.g., the third studs 40, or $n^{th}$ stud, or the like) along the panel length 48. The panel 2 may be operatively coupled to the end support members 31 with couplings 50 at the panel ends 18 (e.g., the first stud 38 and the second stud 42). The panel 2 is further operatively coupled to the one or more intermediate support members 31 with couplings 50 at varying locations. Additionally, two laterally adjacent panels 2 are operatively coupled together with couplings 50 along a sidelap 13. As such, as illustrated in the various figures, the couplings 50 may include end support couplings 52 (e.g., at the panel ends and end support members), panel edge couplings 54 (e.g., at the sidelap between two laterally adjacent panels), edge support couplings 56 (e.g., at the sidelap between two laterally adjacent panels where the sidelap crosses an intermediate support member), and panel support couplings 58 (e.g., between a panel body and where the panel body crosses an intermediate support member).

Figure 2:
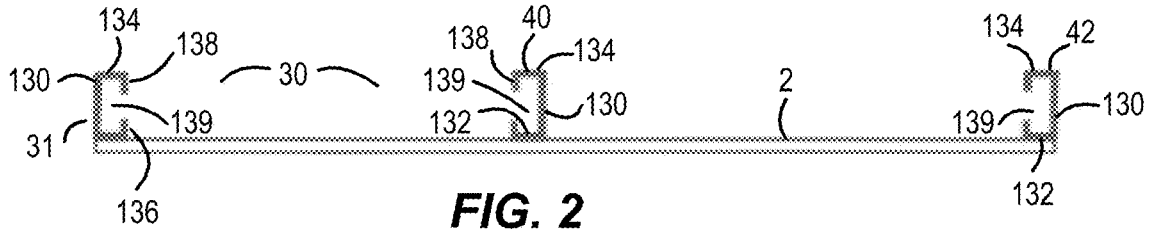
FIG. 2 illustrates a top view of the structural fluted panel system of FIG. 1.

FIG. 1 illustrates a perspective view of a fluted panel system 1 in which the panels 2, and thus the flutes 3 of the panels, are located outside of the width of support members 30 (e.g., outside of the openings 139 formed in the studs 32). FIG. 2 illustrates a top view of the fluted panel system 1 of FIG. 1, which illustrates that the studs 32 may generally be C-shaped studs. As illustrated in FIGS. 1 and 2 the studs 32 have a stud web 130, a first stud flange 132, a second stud flange 134, a first flange lip 136, and a second flange lip 138. The web 130 and flanges 132, 134 of the studs 32 form an opening 139. It should be understood that the lips 136, 138 may increase the strength of the support structure 30. It should be understood that the flanges 132, 134 may be perpendicular to the web 130 (e.g., 90 degrees, or the like), may be substantially perpendicular to the web 130 (e.g., 80 to 100 degrees, or the like), or may be generally perpendicular to the web 130 (e.g., 45 degrees to 135 degrees, or the like). However, it should be understood that flanges 132, 134, if any, may be directed in any orientation and at any angle from the web 130. It should be further understood that the flange lips 136, 138 may be perpendicular to the flanges 132, 134 (e.g., 90 degrees, or the like), may be substantially perpendicular to the flanges 132, 134 (e.g., 80 to 100 degrees, or the like), or may be generally perpendicular to the flanges 132, 134 (e.g., 45 degrees to 135 degrees, or the like). However, it should be understood that flange lips 136, 138, if any, may be directed in any orientation and at any angle from the flanges 132, 134. As such the flange lips 136, 138 may be parallel, substantially parallel, or generally parallel to the stud web 130. As illustrated in FIGS. 1 and 2 the fluted panels 2 are located outside of the width of the support structure 30 (e.g., outside of the openings 139 of the support structure).

Figure 3:
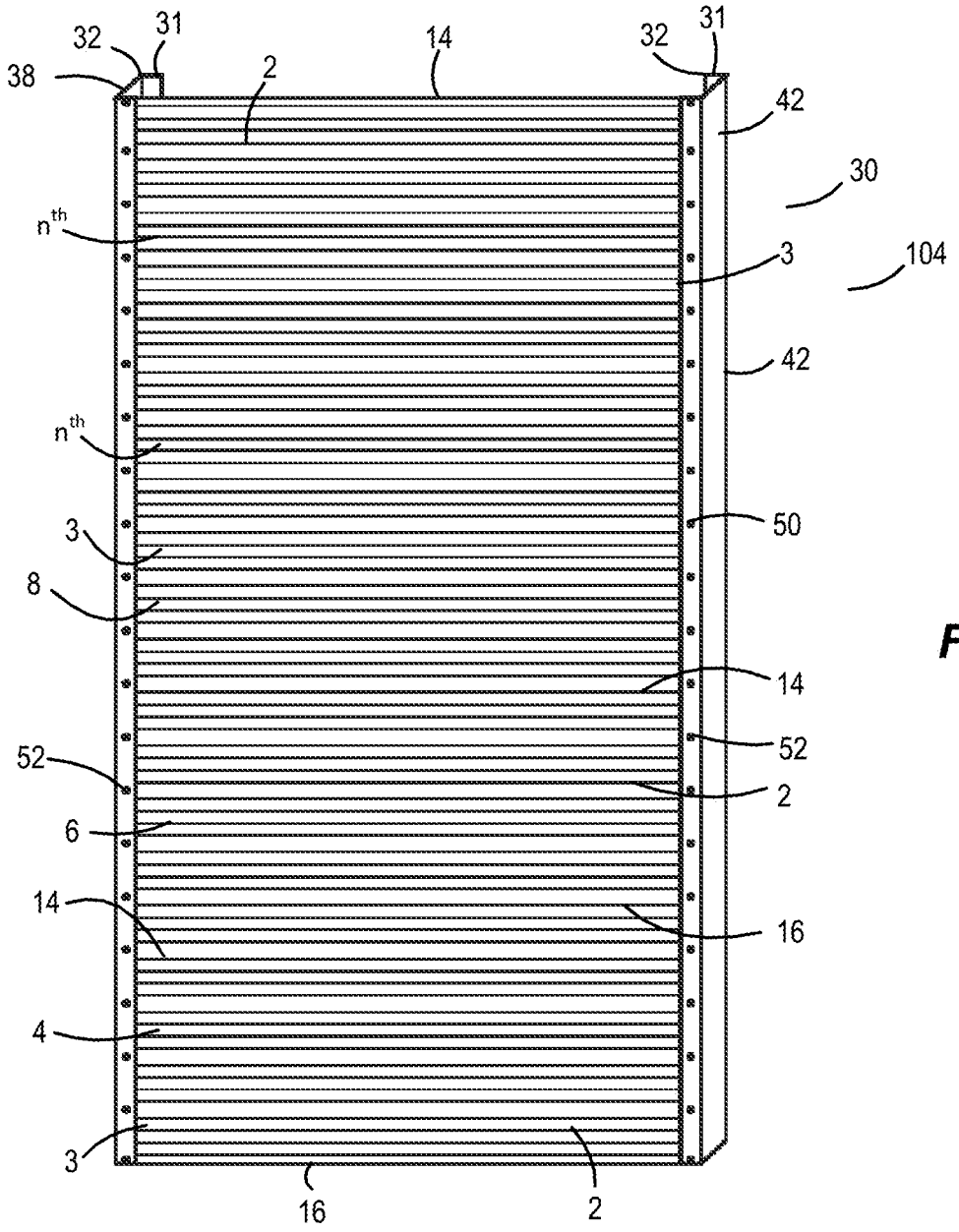
FIG. 3 illustrates a perspective view of a portion of a structural fluted panel system having fluted panels located within the support members of the frame, in accordance with embodiments of the present invention.
Figure 4:
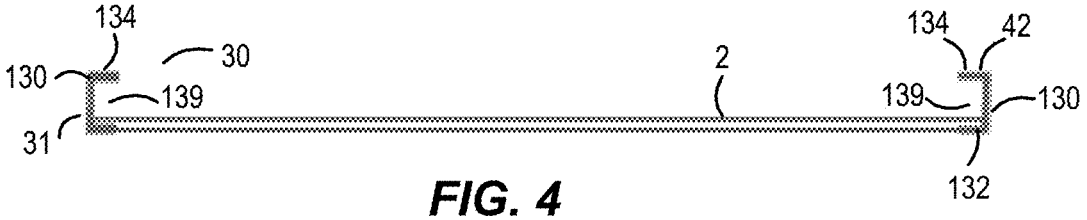
FIG. 4 illustrates a top view of the structural fluted panel system of FIG. 3, in accordance with embodiments of the present invention.

FIG. 3 illustrates a perspective view of a fluted panel system 1 in which the panel edges 18, and thus the flutes 3, are located within the frame (e.g., within the openings 139 of the C-shaped studs 32 of the support structure 30). FIG. 4 illustrates a top view of the fluted panel system 1 of FIG. 3. For example, the first panel edge 20 is located within the opening 139 of the first stud 38, and the second panel edge 22 is located within the opening 139 of the second stud 42. As illustrated in FIGS. 3 and 4, the fluted panel 2 is operatively coupled to the inside of the studs 32 within the opening 139 created by the stud web 130, the first stud flange 132, and the second stud flange 134. As illustrated in FIGS. 3 and 4, the panels 2 may be operatively coupled to the first stud flanges 132 of the studs 32 on the inside edge of the first stud flanges 132 within the opening 139. The first stud flanges 132 are likely located on the side of the building that faces the outside of the building, while the second stud flanges 134 are likely located on the side of the building that faces the inside of the building. However, it should be understood that the panels 2 may be operatively coupled to either of the first or second flanges 132, 134, and as such may be located on the flanges that are adjacent to the outside or inside of the building. It should be understood that to improve the strength of the studs 32 the flanges (e.g., second flanges 134) that are not operatively coupled to the panels 2 may have the flange lips (e.g., second flange lips 134) (not illustrated in FIGS. 5 and 6).

Figure 5:
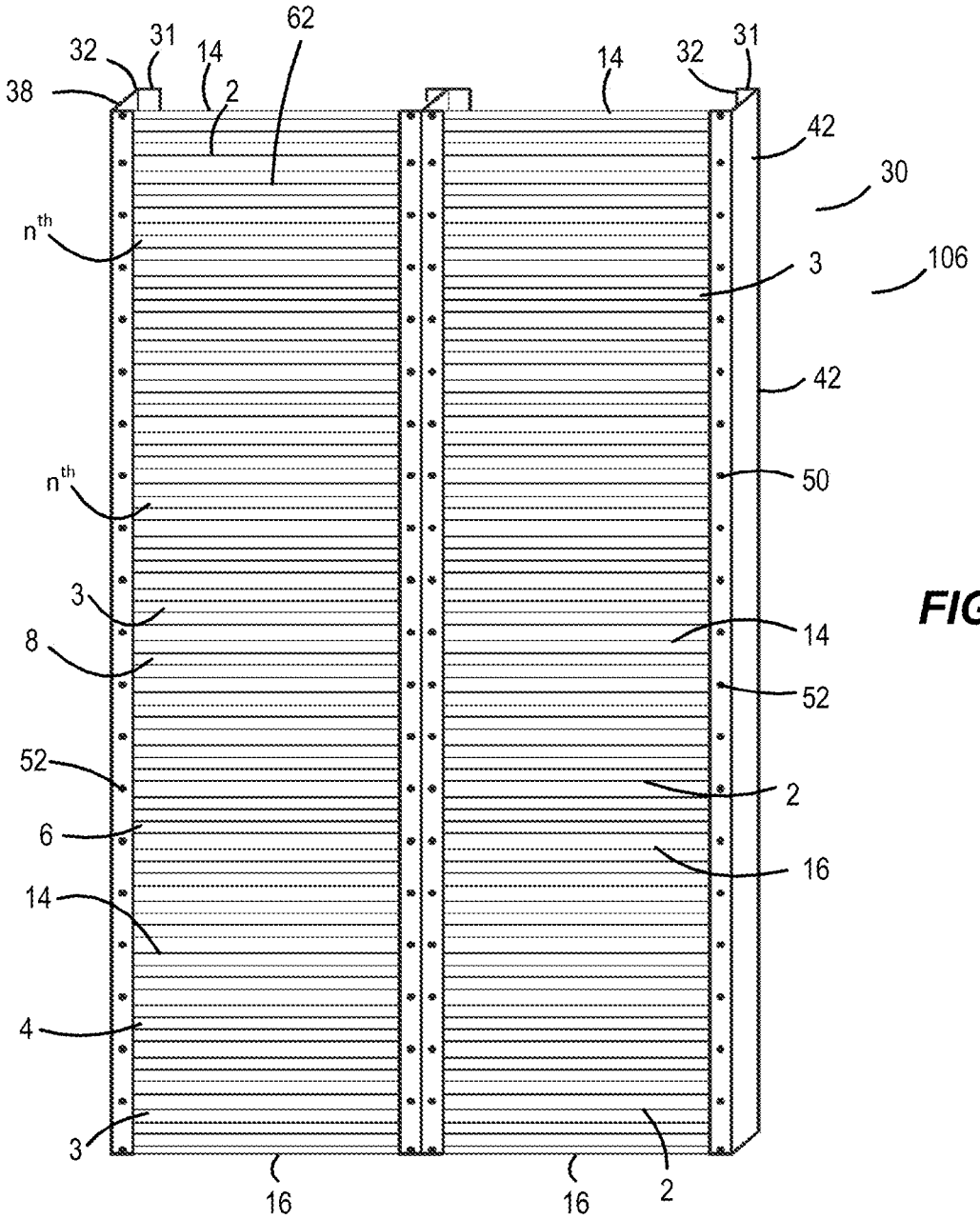
FIG. 5 illustrates a perspective view of a portion of a structural fluted panel system having fluted panels located within the support members of the frame, in accordance with embodiments of the present invention.
Figure 6:
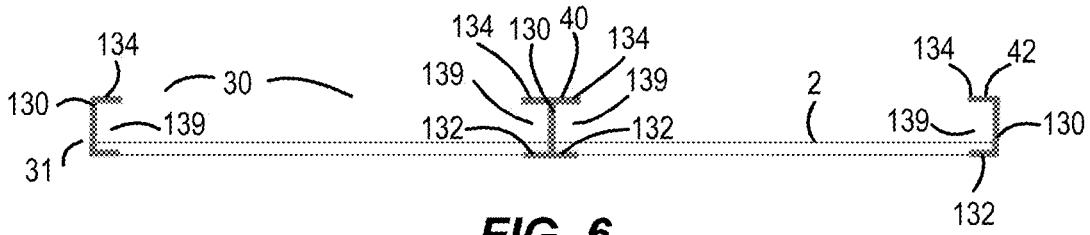
FIG. 6 illustrates a top view of the structural fluted panel system of FIG. 5, in accordance with embodiments of the present invention.

FIG. 5 illustrates a perspective view of a fluted panel system 1 in which the panel edges 18, and thus the flutes 3, are located within the frame (e.g., within the C-shaped studs 32 and/or the I-shaped stud 32 of the support structure 30). FIG. 6 illustrates a top view of the fluted panel system 1 of FIG. 5. As illustrated in FIG. 5, the fluted panel system 1 may include a first panel (otherwise described as a first panel portion 62) between the first stud 38 and the third stud 40 (e.g., intermediate stud), and a second panel (otherwise described as a second panel portion 64) between the second stud 42 and the third stud 40 (e.g., intermediate stud). In some embodiments the first panel portion 62 is one or more first panels, and the second panel portion is one or more second panels. As illustrated in FIGS. 5 and 6, the first stud 38 and the second stud 42 (e.g., end studs) are C-shaped studs, while the third stud 40 (e.g., intermediate studs) may be and I-shaped or H-shaped stud or two C-shaped studs operatively coupled together (e.g., at the webs 130 or at the flanges). As such, the third stud 40 (e.g., intermediate stud) may have a first opening and a second opening. In some examples, the first panel edge 20 of the first panel portion 62 is located within the opening 139 of the first stud 38, and the second panel edge 22 of the first panel portion 62 is located within the first opening 139 of the third stud 40 (e.g., intermediate stud). Moreover, the first panel edge 20 of the second panel portion 64 is located within the opening 139 of the second stud 42, and the second panel edge 22 of the second panel portion 64 is located within the second opening 139 of the third stud 42 (e.g., intermediate stud). As illustrated in FIGS. 5 and 6, the fluted panel 2 is operatively coupled to the inside of the studs 32 within the openings 139 created by the stud web 130, the first stud flange 132, and the second stud flange 134. As illustrated in FIGS. 5 and 6, the panels 2 may be operatively coupled to the first stud flanges 132 of the studs 32 on the inside edge of the first stud flanges 132 on the side facing the openings 139. The first stud flanges 132 are likely located on the side of the building that faces the outside, while the second stud flanges 134 are likely located on the side of the building that faces the inside of the building. However, it should be understood that the panels 2 may be operatively coupled to either of the flanges 132, 134 and/or either of the flanges 132, 134 may face the inside or outside of the building. It should be understood that to improve the strength of the studs 32 the flange that is not operatively coupled to the panels 2 may have the flange lips 136, 138 (not illustrated in FIGS. 5 and 6).

Figure 7:
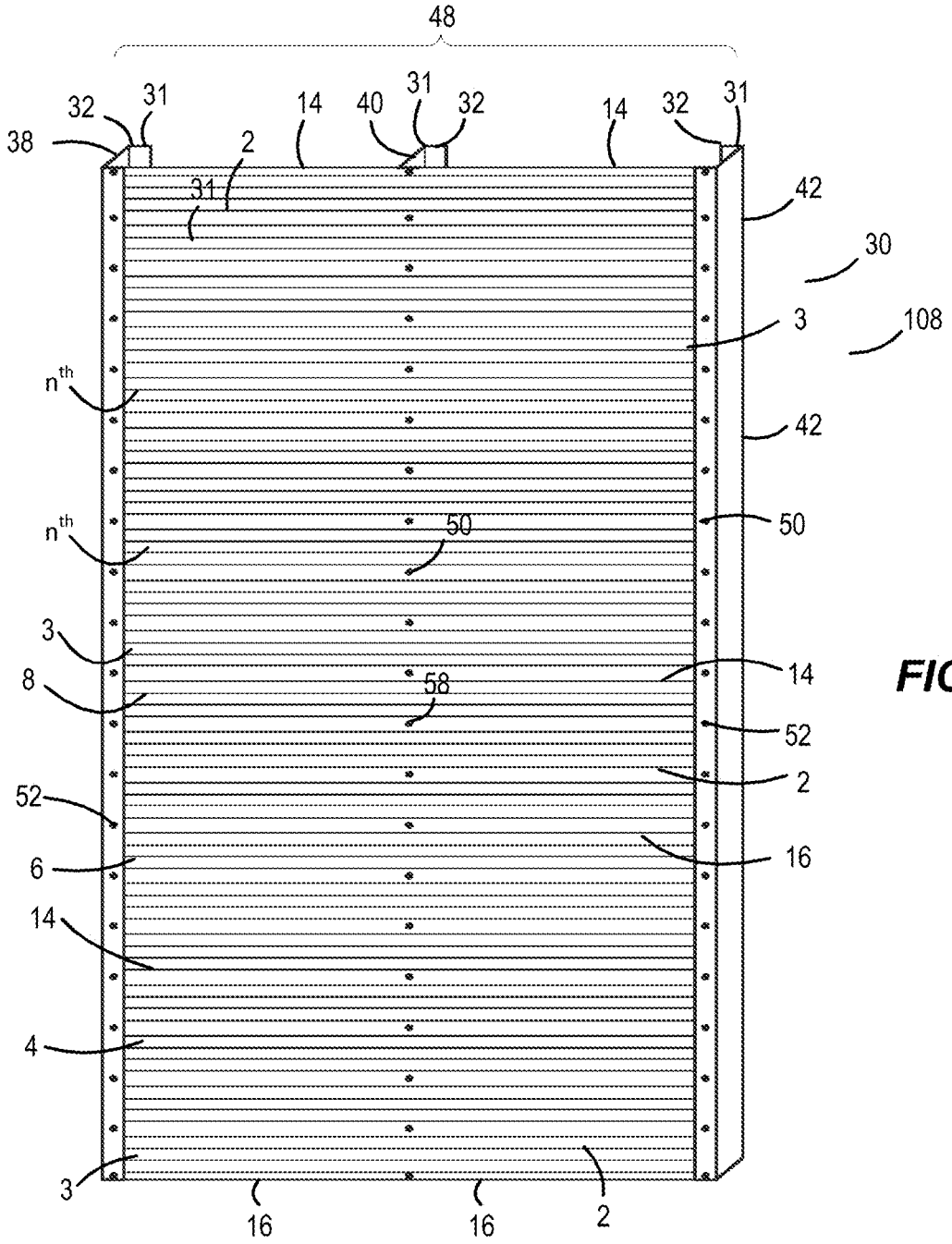
FIG. 7 illustrates a perspective view of a portion of a structural fluted panel system having fluted panels located within the support members of the frame, in accordance with embodiments of the present invention.
Figure 8:
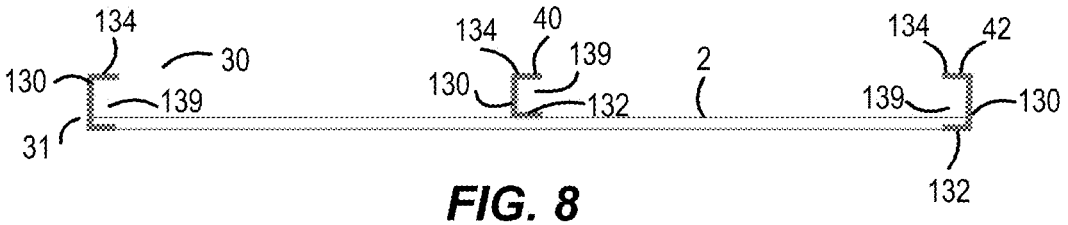
FIG. 8 illustrates a top view of the structural fluted panel system of FIG. 7, in accordance with embodiments of the present invention.

FIG. 7 illustrates a perspective view of a fluted panel system 1 in which the panel edges 18, and thus the flutes 3, are located within the frame (e.g., within the C-shaped studs 32 at the ends of the support structure 30). FIG. 8 illustrates a top view of the fluted panel system 1 of FIG. 7. For example, the first panel edge 20 is located within the opening 139 of the first stud 38, and the second panel edge 22 is located within the opening 139 of the second stud 42. As illustrated in FIGS. 7 and 8, the first stud 38 and the second stud 42 (e.g., end studs) are C-shaped studs in which the fluted panels 2 are operatively coupled within the openings 139. As illustrated in FIGS. 7 and 8 the fluted panels 2 are operatively coupled to the inside of the end studs 32 within the openings 139 created by the stud web 130, the first stud flange 132, and the second stud flange 134. However, the third stud 40 (or one or more intermediate studs) may have a reduced width such that the panels 2 are secured to the second stud 40 (one or more intermediate studs) outside of the opening 139 of the third stud 40. As illustrated in FIGS. 7 and 8 the panels 2 are operatively coupled to the outside surface of the stud flange 132 of the third stud 40 (or one or more intermediate studs). The first stud flanges 132 are likely located on the side of the building that faces the outside of the building, while the second stud flanges 134 are likely located on the side of the building that faces the inside of the building. However, it should be understood that the panels 2 may be operatively coupled to either of the flanges 132, 134. It should be understood that to improve the strength of the studs 32 the flanges that are not operatively coupled to the panels 2 may have flange lips on the end studs 38, 42 (not illustrated in FIGS. 7 and 8). However, the third stud 40 (one or more intermediate studs) may have flange lips 136, 138 on both of the stud flanges 132, 134 (not illustrated in FIGS. 7 and 8).

Each of the panel systems described in FIGS. 1-8 illustrate just a portion of a building system. It should be understood that a building system may have one or more of the fluted panel systems 1 described with respect to FIGS. 1-8, or other fluted panel systems. As such, the fluted panel systems 1 within a building may all be of the same type, or may include combinations of the panel systems 1 illustrated in FIGS. 1-8, or combined with other panel systems not specifically illustrated herein.

Figure 9:
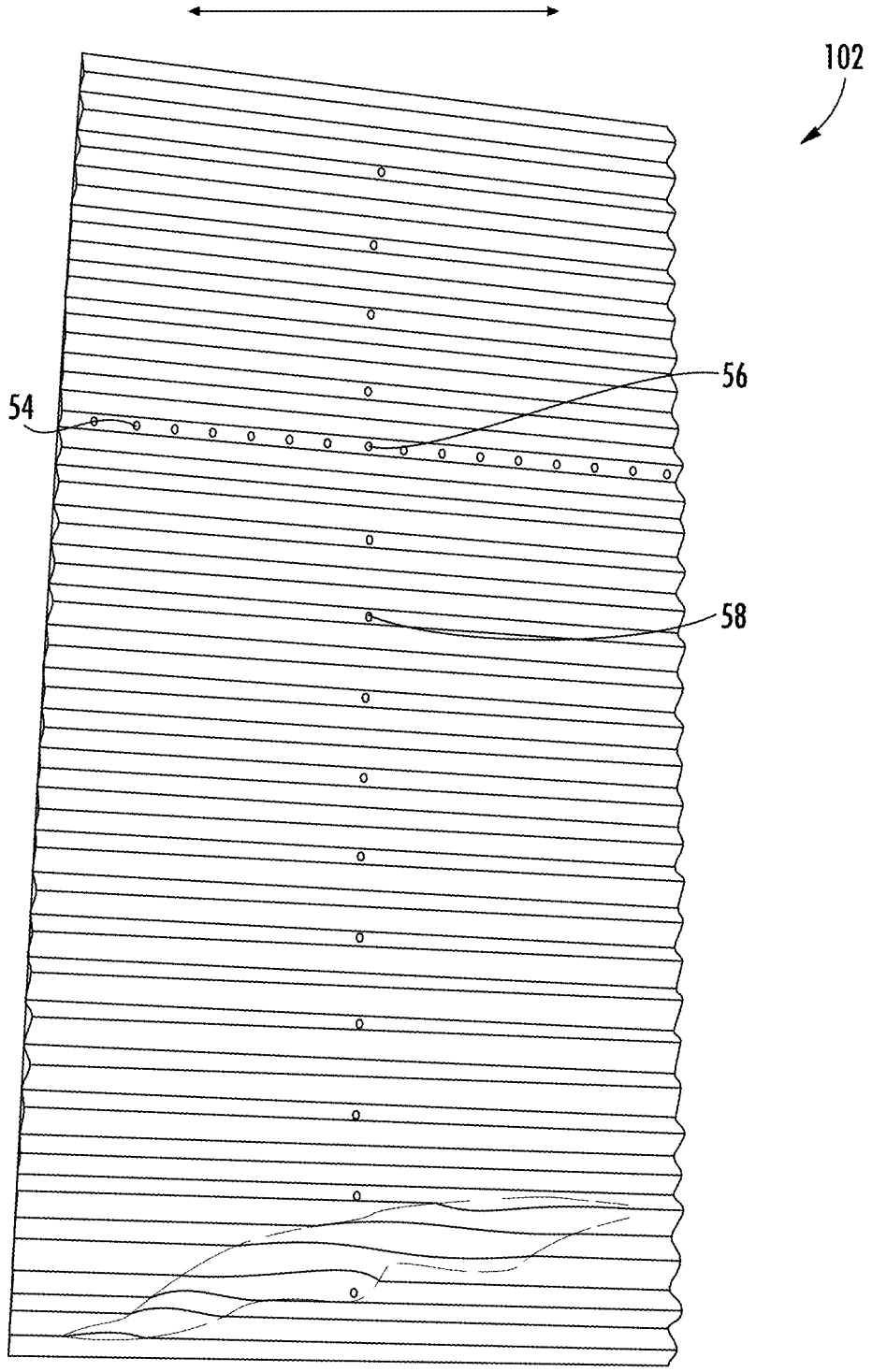
FIG. 9 illustrates a perspective view of the structural fluted panel system of FIG. 1 after shear loading, in accordance with aspects of the present invention.
Figure 10:
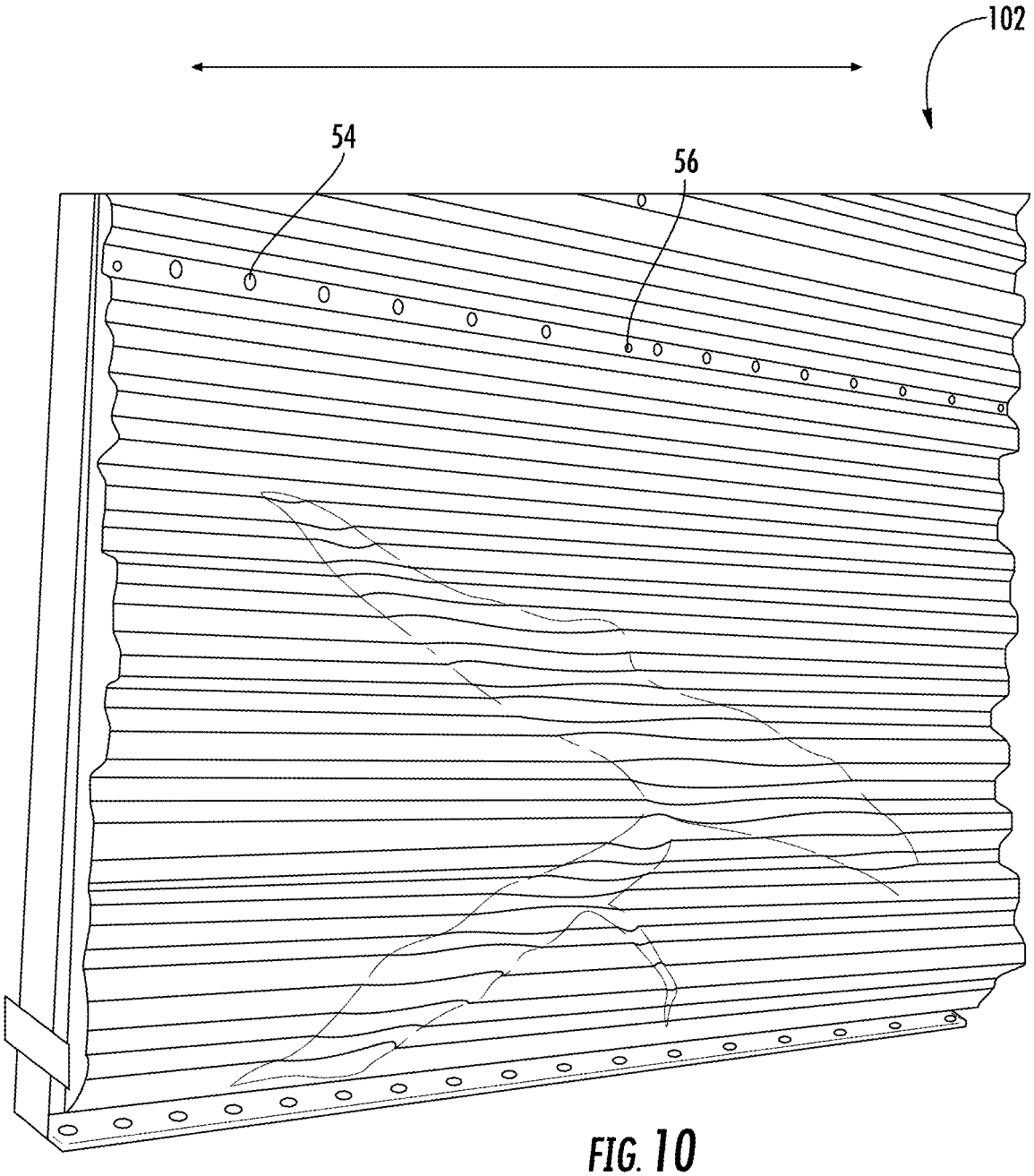
FIG. 10 illustrates a perspective view of a portion of the structural fluted panel system of FIG. 1 after shear loading.
Figure 11:
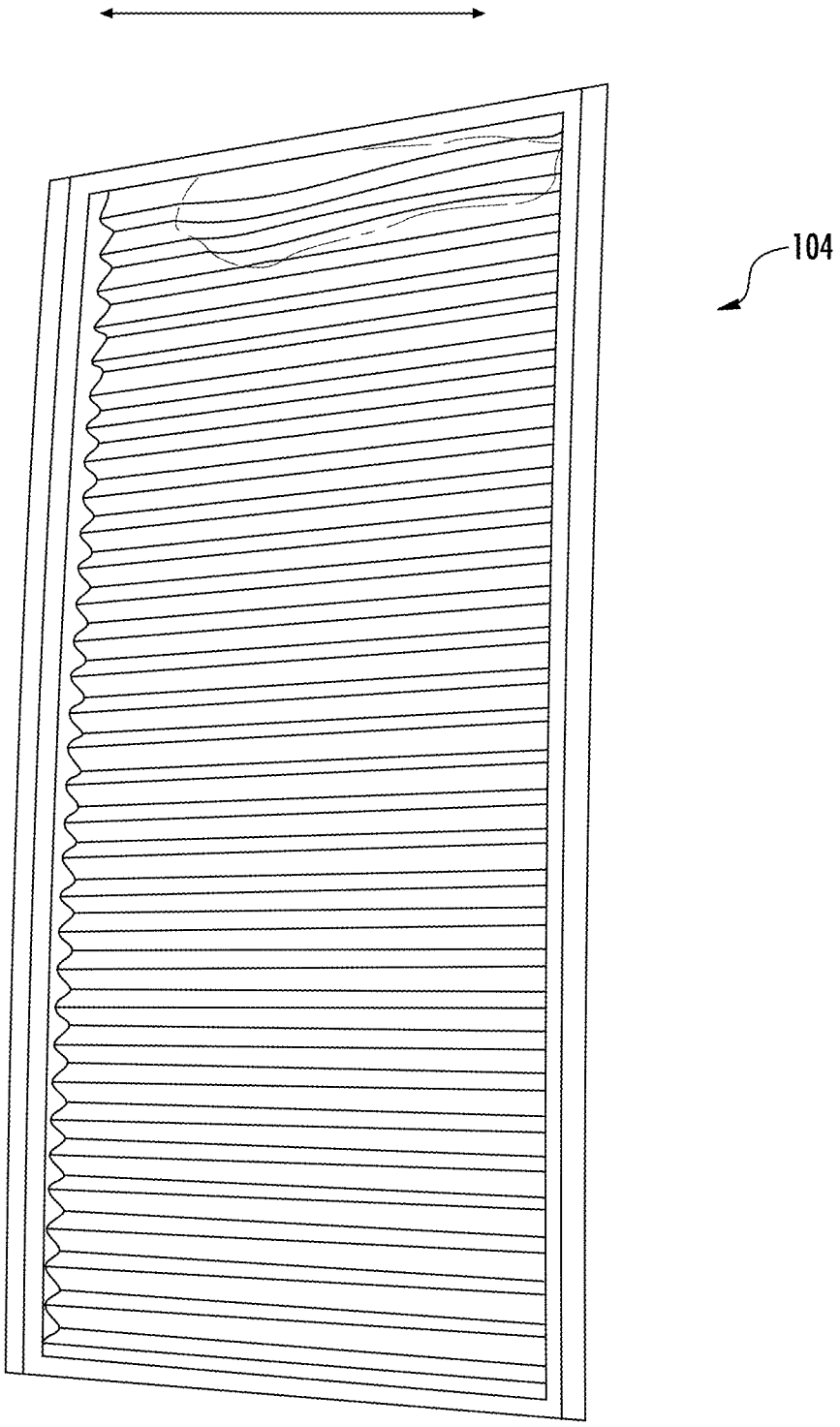
FIG. 11 illustrates a perspective view of the structural fluted panel system of FIG. 3 after shear loading, in accordance with embodiments of the present invention.
Figure 12:
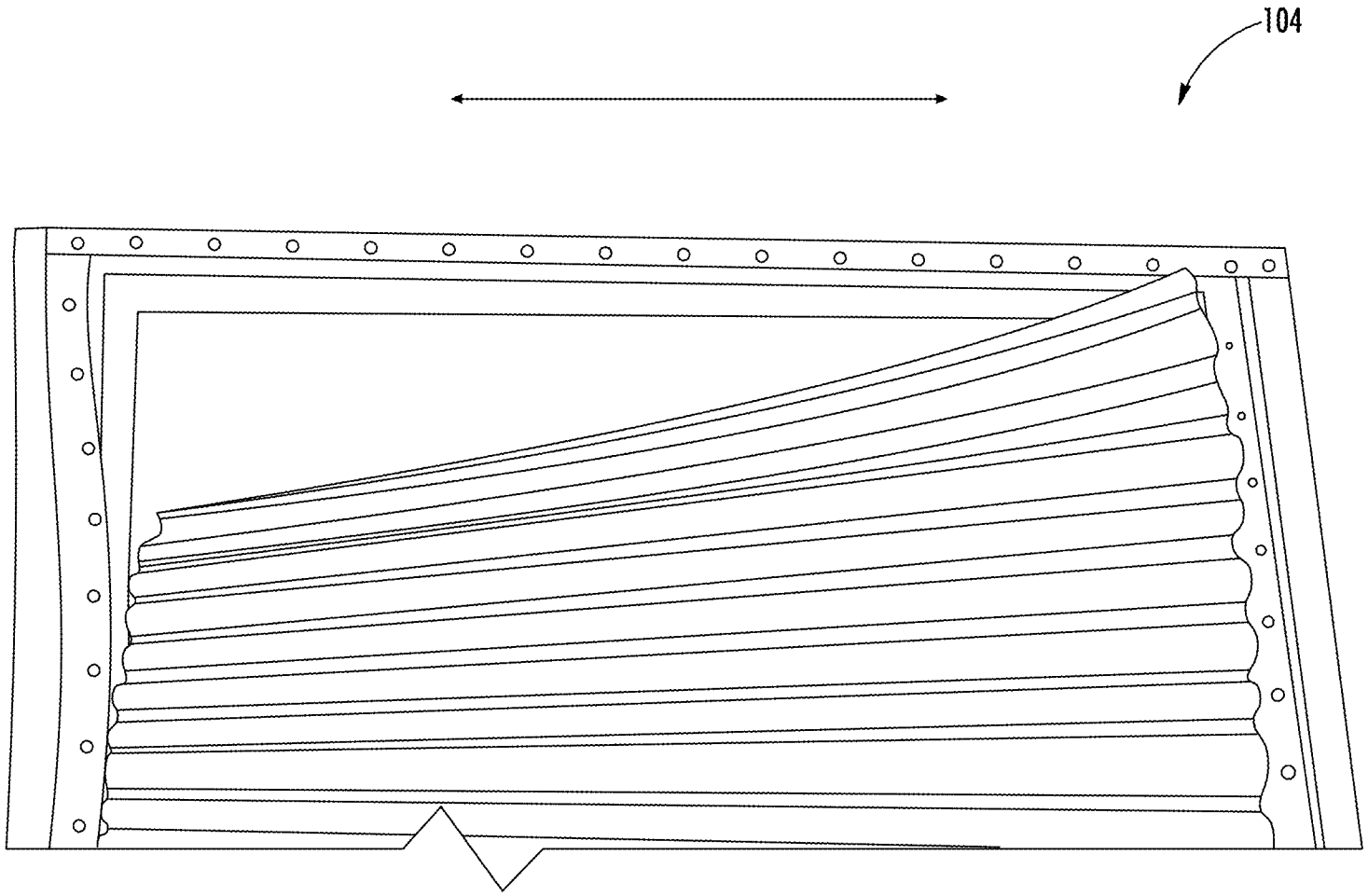
FIG. 12 illustrates a perspective view of a portion of the structural fluted panel system of FIG. 3 after shear loading, in accordance with embodiments of the present invention.
Figure 13:
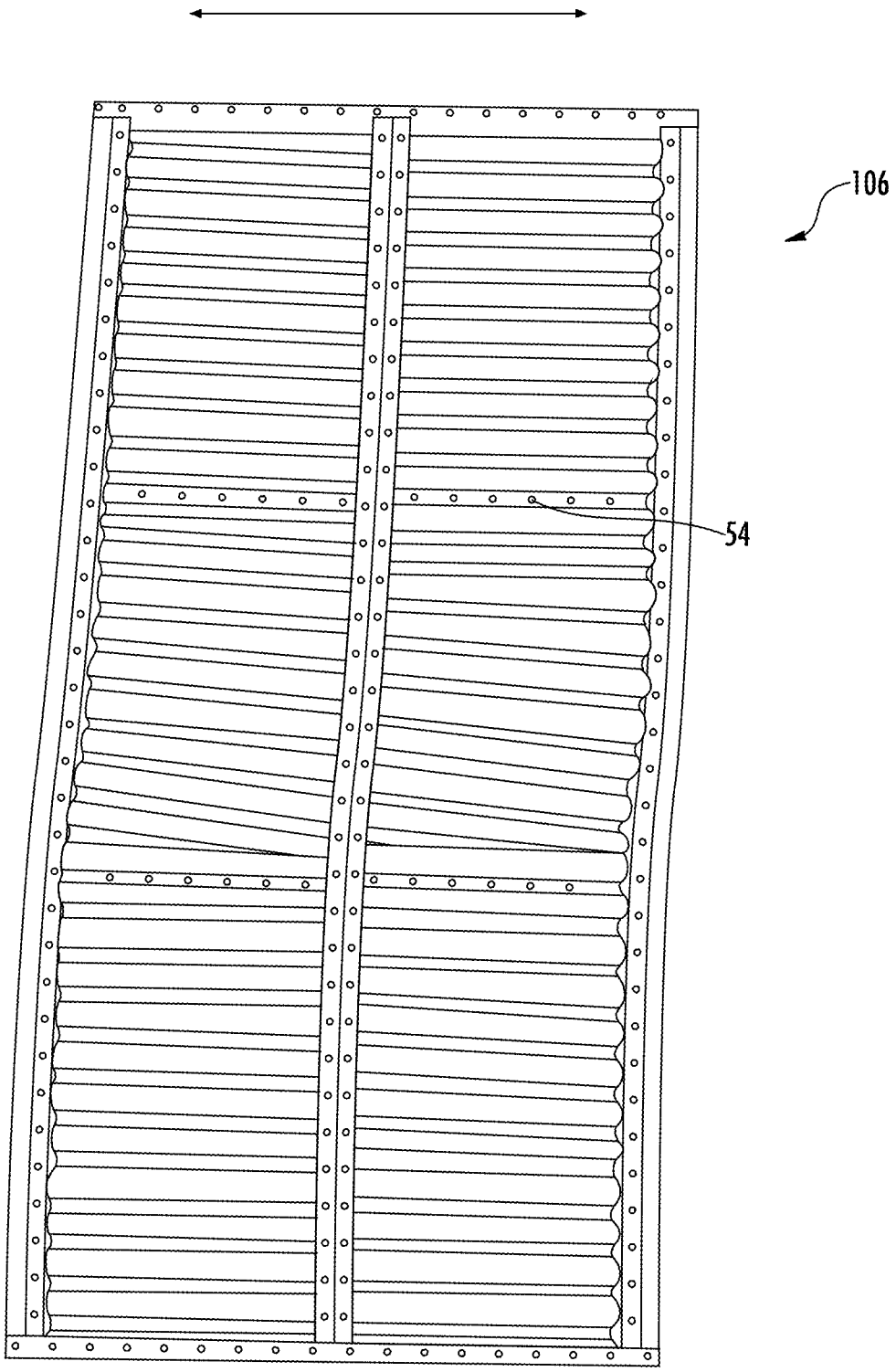
FIG. 13 illustrates a perspective view of the structural fluted panel system of FIG. 5 after shear loading, in accordance with embodiments of the present invention.
Figure 14:
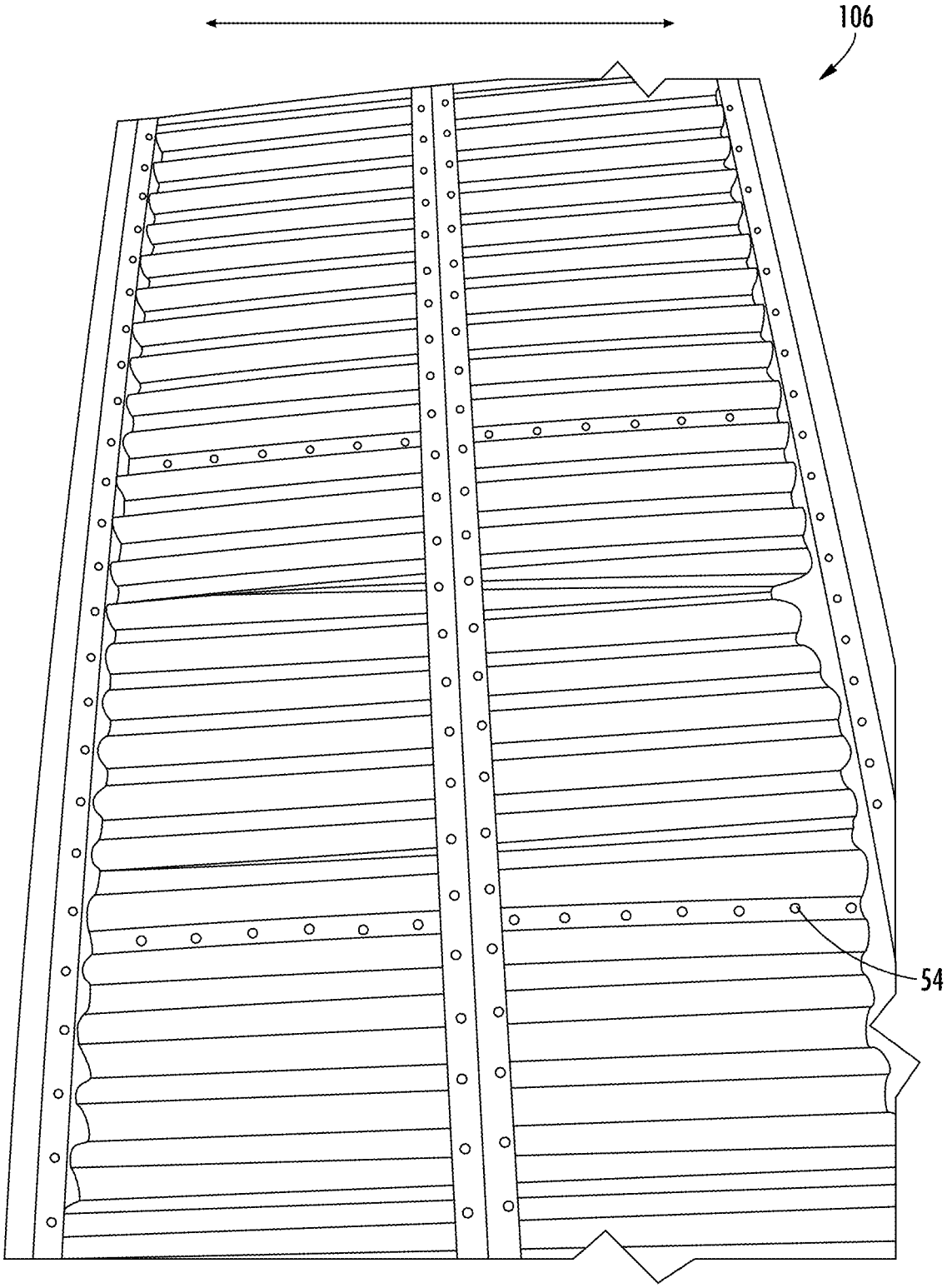
FIG. 14 illustrates a perspective view of the structural fluted panel system of FIG. 5 after shear loading, in accordance with embodiments of the present invention.
Figure 15:
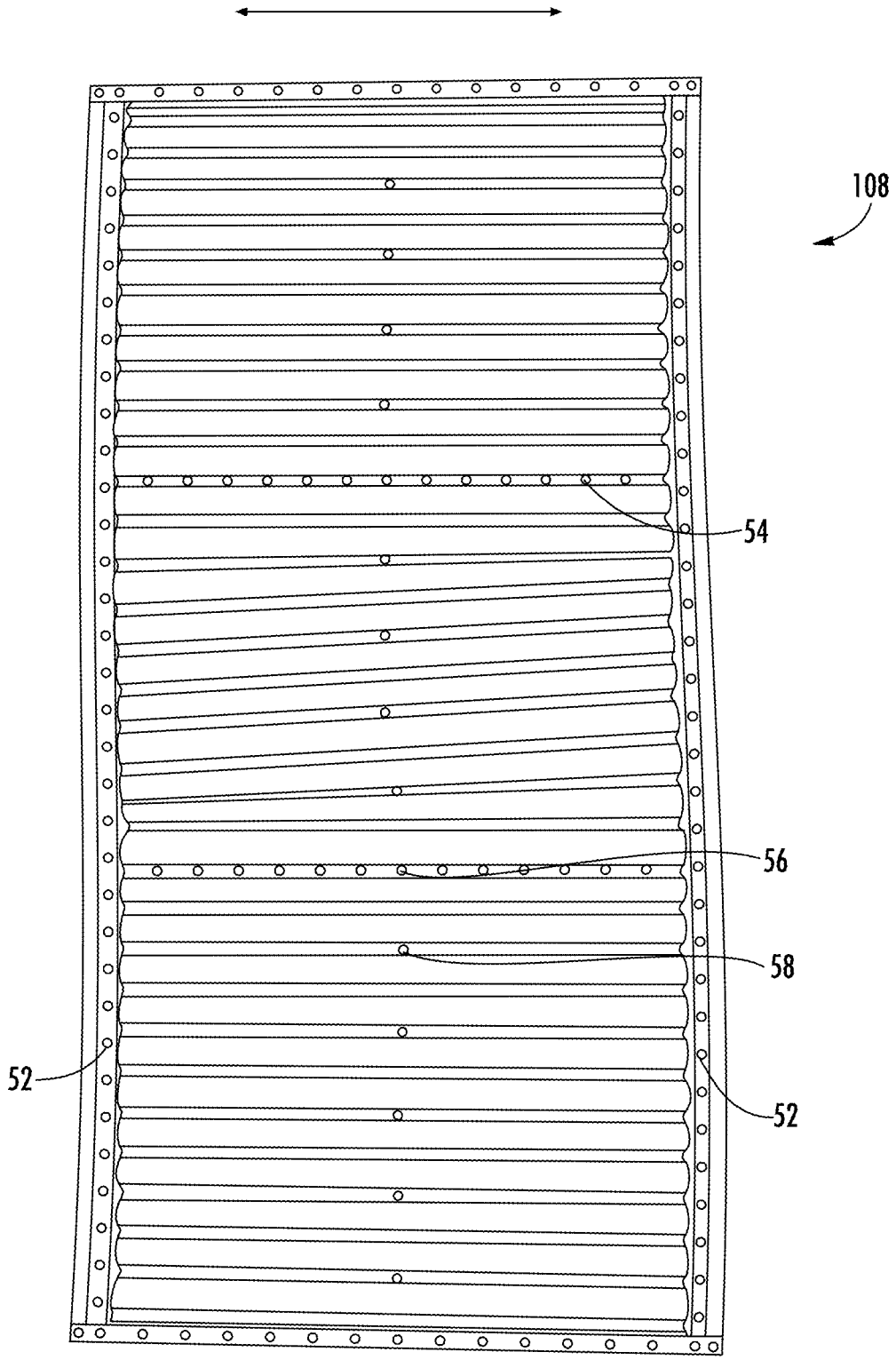
FIG. 15 illustrates a perspective view of the structural fluted panel system of FIG. 7 after shear loading, in accordance with embodiments of the present invention.
Figure 16:
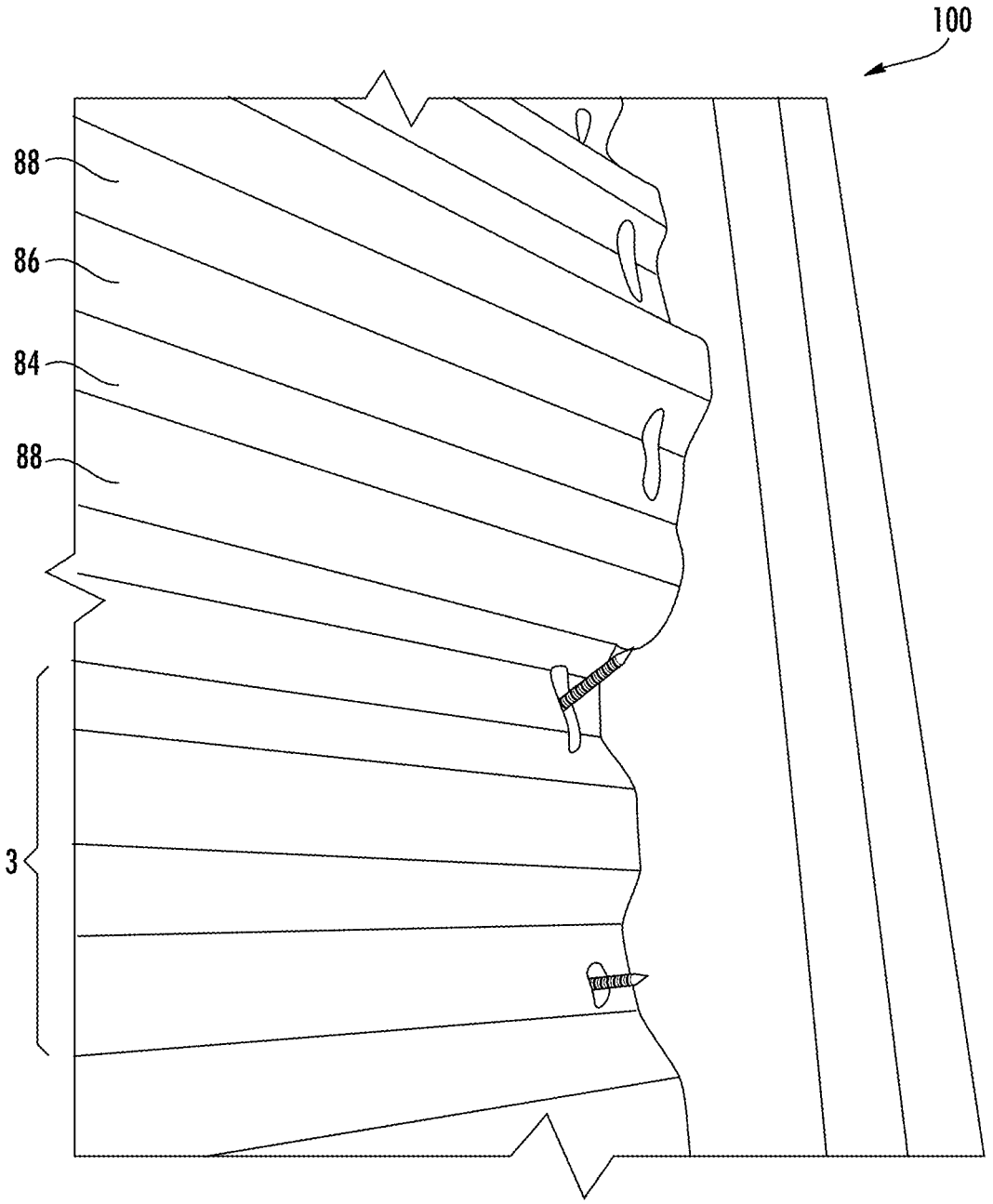
FIG. 16 illustrates a perspective view of a portion of a structural fluted panel system after shear loading, in accordance with embodiments of the present invention.

A number of samples of each of the panel systems described and illustrated with respect to FIGS. 1-8 were installed on a test rig and subjected to shear loading (e.g., as illustrated by the arrows in FIGS. 9-15). FIGS. 9 and 10 illustrate the fluted panel system 1 illustrated and described with respect to FIGS. 1 and 2, after it has been subjected to shear loading. FIGS. 11 and 12 illustrate the fluted panel system 1 illustrated and described with respect to FIGS. 3 and 4, after it has been subjected to shear loading. FIGS. 13 and 14 illustrate the fluted panel system 1 illustrated and described with respect to FIGS. 5 and 6, after it has been subjected to shear loading. FIG. 15 illustrates the fluted panel system 1 illustrated and described with respect to FIGS. 7 and 8, after it has been subjected to shear loading. FIG. 16 illustrates a fluted panel system 1 when viewed from a side opposite to the side at which the panels 2 are coupled to the flanges of the studs 32. FIGS. 9-16 illustrate the panel systems 1 after they have been subjected to cyclic shear loading to failure.

Tests were run for the configurations illustrated in FIGS. 1 and 2, 3 and 4, 5 and 6, and 7 and 8. The Peak Load (pound per liner foot, plf), the Drift at Peak (%), the Initial Stiffness (plf/in), and the Ductility Factor were determined for each of the tests for the configurations in FIGS. 1-8. The results of the tests are displayed in Table 1 below.

TABLE 1

Fluted Panel System Shear Loading Testing

| | Out-of-Frame (FIGS. 1 and 2) | In-Frame with no Intermediate Stud (FIGS. 3 and 4) | In-Frame with Two Coupled Intermediate Studs (FIGS. 5 and 6) | In-Frame with Reduced Width Intermediate Stud (FIGS. 7 and 8) |
|---|---|---|---|---|
| Peak Load (plf) | 3600 | 2410 | 3257 | 3984 |
| Drift @ Peak (%) | 2.59% | 1.90% | 2.21% | 2.28% |
| Initial Stiffness (plf/in.) | 1886 | 2052 | 2033 | 2567 |
| Ductility Factor | 1.82 | 2.84 | 2.22 | 2.25 |

Figure 17:
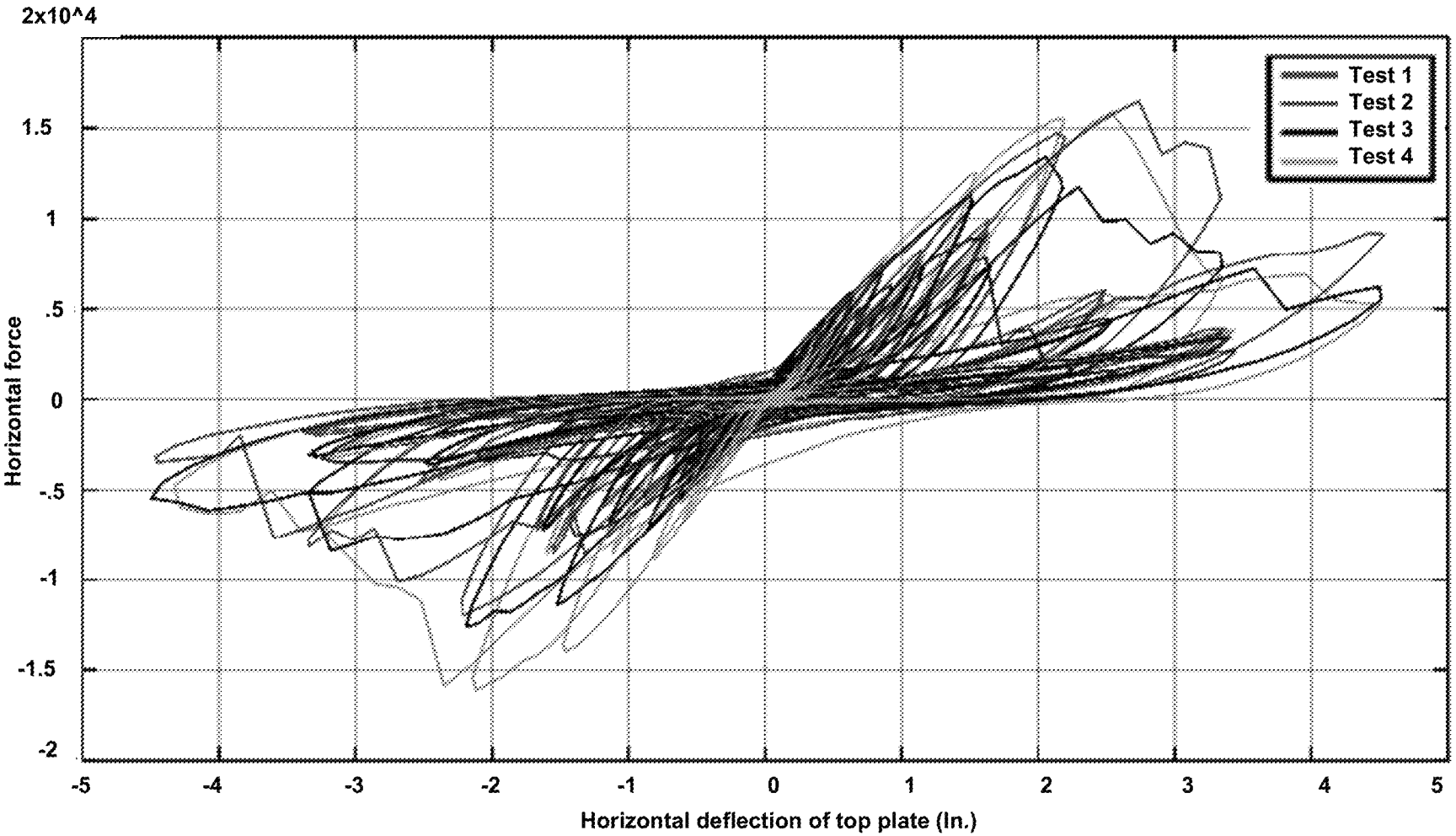
FIG. 17 illustrates a graph of the load displacement of panel systems, in accordance with embodiments of the present invention.

FIG. 17 illustrates cyclic load displacement curves for each of the out-of-frame 102, in-frame with no intermediate stud 104, in-frame with two coupled intermediate studs 106, and in-frame with reduced width intermediate stud 108 configurations. The loading/deflection chart illustrates the deflection of the fluted panel systems 1 during and after peak loading. As illustrated in the specific examples in FIG. 17, the in-frame with reduced width intermediate stud 108 configuration shows similar strength and displacement at peak loading and subsequent cyclic loading as the out-of-frame 102 configuration.

As illustrated by Table 1 and the curves in FIG. 17, the in-frame configurations 104, 106, 108 have the same, similar, or improved properties when compared to the out-of-frame configuration 102. More particularly, the in-frame with reduced with intermediate stud 108 configuration had improved strength over the out-of-frame 102 configuration.

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A building having structural panel systems, the building comprising:

a plurality of building support members; and a plurality of structural panel systems, wherein each structural panel system forms at least a portion of a structural wall and is operatively coupled to one or more building support members of the plurality of building support members, and wherein the structural panel system comprises:

a first support member having a first web operatively coupled to two flanges defining a first opening;

a second support member having a second web operatively coupled to two flanges defining a second opening; and one or more panels operatively coupled to the first support member and the second support member through support member couplings, wherein each of the one or more panels comprise flutes, opposing ends, and opposing edges, wherein the flutes comprise a top flange that is operatively coupled to a portion of adjacent bottom flanges through two panel webs, wherein the flutes of the one or more panels are generally parallel with the opposing edges, wherein the flutes of the one or more panels are oriented generally perpendicular with the first support member and the second support member in a horizontal orientation, wherein the one or more panels are formed from sheet steel; and wherein the opposing ends of the one or more panels are located within the first opening of the first support member and the second opening of the second support member within a width of the first web of the first support member and the second web of the second support member.

2. The building of claim 1, wherein the structural panel system further comprises:

one or more intermediate support members operatively coupled to the one or more panels.

3. The building of claim 2, wherein the one or more intermediate support members have an intermediate width that is less than the first web of the first support member and the second web of the second support member, and wherein the one or more panels are operatively coupled to the one or more intermediate support members outside of the intermediate width.

4. The building of claim 3, wherein the one or more intermediate support members comprise:

a first intermediate flange, a second intermediate flange, and an intermediate web operatively coupled to the first intermediate flange and the second intermediate flange defining an intermediate opening, and wherein the intermediate web defines the intermediate width of the one or more intermediate support members that is less than the width of the first web of the first support member and the second web of the second support member.

5. The building of claim 2, wherein the one or more intermediate support members comprise:

an intermediate support member having an intermediate web operatively coupled to a first intermediate flange and a second intermediate flange defining a first intermediate opening and a second intermediate opening, wherein an intermediate web width is the same as the width of the first support member and the second support member;

wherein the one or more panels comprise at least a first panel and a second panel, wherein the opposing ends of the first panel are located within the first opening of the first support member and the first intermediate opening of the intermediate support member, and wherein the opposing ends of the second panel are located within the second opening of the second support member and the second intermediate opening of the intermediate support member.

6. The building of claim 5, wherein the intermediate support member comprises a first intermediate support member and a second intermediate support member operatively coupled together, wherein the intermediate web of the intermediate support member is formed from a first intermediate web of the first intermediate support member directly operatively coupled to a second intermediate web of the second intermediate support member.

7. The building of claim 5, wherein the intermediate support member comprises a single member having an I-shape or H-shape.

8. The building of claim 1, wherein the first support member and the second support member are c-shaped.

9. The building of claim 2, wherein the structural panel system further comprises:

an upper track; and a lower track;

wherein the upper track and the lower track are operatively coupled to the first support member, the second support member, and the one or more intermediate support members, and wherein the upper track and the lower track are perpendicular to the first support member, the second support member, and the one or more intermediate support members in the horizontal orientation; and wherein the upper track and the lower track are operatively coupled to at least one opposing edge of the opposing edges of the one or more panels.

10. A structural panel system for a building, the system comprising:

a first support member having a first web operatively coupled to two flanges defining a first opening;

a second support member having a second web operatively coupled to two flanges defining a second opening; and one or more panels operatively coupled to the first support member and the second support member through support member couplings, wherein each of the one or more panels comprise flutes, opposing ends, and opposing edges, wherein the flutes comprise a top flange that is operatively coupled to a portion of adjacent bottom flanges through two panel webs, wherein the flutes of the one or more panels are generally parallel with the opposing edges, wherein the flutes of the one or more panels are oriented generally perpendicular with the first support member and the second support member in a horizontal orientation, and wherein the one or more panels are formed from sheet steel; and wherein the opposing ends of the one or more panels are located within the first opening of the first support member and the second opening of the second support member within a width of the first web of the first support member and the second web of the second support member:, and wherein the structural panel system forms at least a portion of a structural wall for the building.

11. The system of claim 10, further comprising:

one or more intermediate support members operatively coupled to the one or more panels.

12. The system of claim 11, wherein the one or more intermediate support members have an intermediate width that is less than the first web of the first support member and the second web of the second support member, and wherein the one or more panels are operatively coupled to the one or more intermediate support members outside of the intermediate width.

13. The system of claim 12, wherein the one or more intermediate support members comprise:

a first intermediate flange, a second intermediate flange, and an intermediate web operatively coupled to the first intermediate flange and the second intermediate flange defining an intermediate opening, and wherein the intermediate web defines the intermediate width of the one or more intermediate support members that is less than the width of the first web of the first support member and the second web of the second support member.

14. The system of claim 11, wherein the one or more intermediate support members comprise:

an intermediate support member having an intermediate web operatively coupled to a first intermediate flange and a second intermediate flange defining a first intermediate opening and a second intermediate opening, wherein an intermediate web width is the same as the width of the first support member and the second support member;

wherein the one or more panels comprise at least a first panel and a second panel, wherein the opposing ends of the first panel are located within the first opening of the first support member and the first intermediate opening of the intermediate support member, and wherein the opposing ends of the second panel are located within the second opening of the second support member and the second intermediate opening of the intermediate support member.

15. A method of forming a building, the method comprising:

assembling a plurality of building support members together; and assembling a plurality of structural panel systems to one or more building support members of the plurality of building support members, wherein each of the plurality of structural panel systems form at least a portion of a structural wall for the building, wherein assembling each of the plurality of structural panel systems comprise:

assembling a first support member to the one or more building support members, wherein the first support member has a first web operatively coupled to two flanges defining a first opening;

assembling a second support member to the one or more building support members, wherein the second support member has a second web operatively coupled to two flanges defining a second opening; and assembling one or more panels to the first support member and the second support member through support member couplings, wherein each of the one or more panels comprise flutes, opposing ends, and opposing edges, wherein the flutes comprise a top flange that is operatively coupled to a portion of adjacent bottom flanges through two panel webs, wherein the flutes of the one or more panels are generally parallel with the opposing edges, wherein the flutes of the one or more panels are oriented generally perpendicular with the first support member and the second support member in a horizontal orientation, wherein the one or more panels are formed from sheet steel, and wherein the opposing ends of the one or more panels are located within the first opening of the first support member and the second opening of the second support member within a width of the first web of the first support member and the second web of the second support member.

16. The method of claim 15, further comprising:

assembling one or more intermediate support members to the one or more building support members.

17. The method of claim 16, wherein the one or more intermediate support members have an intermediate width that is less than the first web of the first support member and the second web of the second support member, and wherein the one or more panels are assembled to the one or more intermediate support members outside of the intermediate width.

18. The method of claim 17, wherein the one or more intermediate support members comprise:

a first intermediate flange, a second intermediate flange, and an intermediate web operatively coupled to the first intermediate flange and the second intermediate flange defining an intermediate opening, and wherein the intermediate web defines the intermediate width of the one or more intermediate support members that is less than the width of the first web of the first support member and the second web of the second support member.

19. The method of claim 16, wherein the one or more intermediate support members comprise:

an intermediate support member having an intermediate web operatively coupled to a first intermediate flange and a second intermediate flange defining a first intermediate opening and a second intermediate opening, wherein an intermediate web width is the same as the width of the first support member and the second support member;

wherein the one or more panels comprise at least a first panel and a second panel, wherein the opposing ends of the first panel are located within the first opening of the first support member and the first intermediate opening of the intermediate support member, and wherein the opposing ends of the second panel are located within the second opening of the second support member and the second intermediate opening of the intermediate support member.

20. The method of claim 16, further comprises:

assembling a lower track to the one or more building support members or the first support member, the second support member, and the one or more intermediate support members;

assembling an upper track to the first support member, the second support member, and the one or more intermediate support members;

wherein the upper track and the lower track are perpendicular to the first support member, the second support member, and the one or more intermediate support members in the horizontal orientation; and wherein the upper track and the lower track are operatively coupled to at least one opposing edge of the opposing edges of the one or more panels.

* * * * *